United States Patent [19]

Djordjevic et al.

[11] Patent Number: 4,539,964

[45] Date of Patent: Sep. 10, 1985

[54] FUEL INJECTION PUMP STRUCTURE FOR AN INTERNAL COMBUSTION ENGINE

[75] Inventors: Ilja Djordjevic, Windsor, Conn.; Franz Eheim; Helmut Laufer, both of Stuttgart, Fed. Rep. of Germany

[73] Assignee: Robert Bosch GmbH, Stuttgart, Fed. Rep. of Germany

[21] Appl. No.: 634,546

[22] Filed: Jul. 26, 1984

[30] Foreign Application Priority Data

Aug. 30, 1983 [DE] Fed. Rep. of Germany ..... 3331149

[51] Int. Cl.[3] ..... F02M 37/04

[52] U.S. Cl. ..... 123/509; 123/357; 123/198 C

[58] Field of Search ..... 123/509, 495, 198 R, 123/198 C, 195 C, 357–359; 417/289, 294

[56] References Cited

U.S. PATENT DOCUMENTS

| | | | |
|---|---|---|---|
| 3,702,577 | 11/1972 | Staudt et al. | 123/495 |
| 4,280,454 | 7/1981 | Skinner | 123/509 |
| 4,322,174 | 3/1982 | Ishii et al. | 123/509 |
| 4,380,221 | 4/1983 | Eheim | 123/357 |
| 4,411,237 | 10/1983 | Ableitner et al. | 123/509 |

FOREIGN PATENT DOCUMENTS

| | | | |
|---|---|---|---|
| 2652950 | 5/1978 | Fed. Rep. of Germany | 123/198 C |

*Primary Examiner*—Magdalen Y. C. Moy

*Attorney, Agent, or Firm*—Frishauf, Holtz, Goodman & Woodward

[57] ABSTRACT

To provide for accurate alignment of a housing (10) retaining a fuel injection element (12, 15), and a second housing (23) retaining a control element controlling a function of the fuel injection element, in which the relative positions of the pump housing (10) and of the control element housing (23) are determinative of adjustment and alignment of interengagement between the injection element and the control element, the two housings are provided with attachment screws to attach them securely together, while permitting respective removal, for example for replacement of a sealing gasket (26), and to insure precisely aligned re-assembly, the housings include position locating means (27–34, 35') such as interengaging projection-and-recess means (40, 50, 60, 70, 80, 90, 100, 110; 37, 47, 57, 67, 77, 87, 97, 107) which accurately position the housings with respect to each other, and which are positionable after the housings have been first assembled and aligned to provide for said adjusted and aligned interengagement of the injection element and the control element and reestablishment of said aligned position after separation of the housings. The housings may, also, be spot-welded at selected points beyond break-away zones so that, upon breaking away of the spot welds, they can be separated, with subsequent re-alignment based on the break-away zones.

15 Claims, 10 Drawing Figures

FUEL INJECTION PUMP STRUCTURE FOR AN INTERNAL COMBUSTION ENGINE

Reference to related patent, assigned to the assignee of the present application, the disclosure of which is hereby incorporated by reference: U.S. Pat. No. 4,380,221, issued Apr. 19, 1983, EHEIM, co-inventor of the present application.

The present invention relates to a fuel injection pump, and more particularly to a fuel injection pump suitable for injecting pressurized fuel for an internal combustion engine, for example a Diesel engine, and especially to a pump of the type described in the referenced U.S. Pat. No. 4,380,221, EHEIM, in which a rotary magnetic control element forming part of a control assembly is engageable with a slider element on a power piston to control the quantity of fuel being injected.

BACKGROUND

The referenced U.S. Pat. No. 4,380,221 describes a combination fuel injection and distributor pump, for example suitable for automotive-type Diesel engines, in which a pump piston is reciprocated in conventional manner, for example by a cam, and the quantity of fuel is controlled by selectively opening a bypass or drain line, during the return pump stroke, and positioning a closing element with respect to the bypass duct in the piston so that a drain connection is opened at selected instances in dependence on the position of the closing element. The position of the closing element itself is controlled by a fuel quantity control element, for example an eccenter, engaging the slider, for example in form of a collar, to position the collar with respect to the bypass duct so that it will be exposed to permit drainage of pressurized fuel earlier or later in dependence on the respective axial position of the collar.

The fuel quantity positioning element, typically the collar surrounding the injection piston in form of a ring slider, is coupled for positioning by a rotary magnet, which controls the position of the eccenter, and forming the fuel quantity control element. The position of the slider with respect to the bypass duct must be accurately adjusted so that the quantity of fuel is properly associated with the movement of the injection piston. Since the pump and distributor combination provides fuel under substantial pressure, it is necessary to seal the positioning housing with respect to the fuel portion by seals which have the tendency, in due course of operation, to deteriorate and hence to leak. The seals and gaskets, thus, may require replacement from time to time. During replacement, it is necessary to remove the housing of the positioning structure from the housing of the pump structure itself, and then reassemble the housings together, after replacing sealing rings or gaskets. Upon re-assembly, it has been necessary to re-calibrate the positioning element arrangement with respect to the stroke of the piston, which is time-consuming and, effectively, can be carried out only on a test stand.

THE INVENTION

It is an object to so construct the housing for the pump portion and the housing for the control element portion that, after separation, for example to change sealing elements or gaskets, the respective housing elements will be again associated in precisely predetermined position so that the relative adjustment of the fuel quantity control element and the piston of the injection pump will be maintained.

Briefly, the pump housing and the control element housing are formed with position locating means, typically interengaging locating elements, which control the relative alignment and positioning of the housings with respect to each other, so that, once adjusted, the adjustment will be maintained. The housings can then be secured to each other by attachment screws which can pass through usual and customary screw attachment holes, with clearance, since the positioning of the housing parts is independently determined.

In accordance with a feature of the invention, the elements which determine the positioning of the housing parts with respect to each other are interengaging pin-and-recess or similar elements which, after first calibration of the two housing parts, subsequently constrain a similar alignment of the pump housing and the quantity positioning or control element housing; in accordance with another form of the invention, the two housings are welded together at selected points, for example by spot welds, which are located at break-away surface extensions. For separation, the break-away extensions are broken off, and the housings, upon re-assembly, are assembled with precisely matching surfaces at the break-away points.

The arrangement has the advantage the re-calibration of the fuel quantity control elements within the housing and the injection piston engagement region thereof can be done once, upon manufacture, and a fixed, unvarying association of the housing for the fuel control element and for the injection pump piston is then insured. Thus, replacement of seals, gaskets and the like, which are subject to deterioration and periodic change, is easily possible without requiring any additional calibration or adjustment steps.

DRAWINGS

FIGS. 9*a* and 9*b* are fragmentary axial views showing another arrangement, in which FIG. 9*a* is illustrative of an original adjustment, and FIG. 9*b* illustrative of the arrangement after an initial separation.

DETAILED DESCRIPTION

A complete fuel injection pump of the type to which the present invention relates is shown in the referenced U.S. Pat. No. 4,380,221 and in four "EHEIM" patents cited therein, namely U.S. Pat. Nos. 3,661,130; 4,318,378; 4,345,563; and EHEIM et al., U.S. Pat. No. 4,325,337. All those patents include disclosures which illustrate some features of the pump to which the present invention relates, and the listing is given for the convenience of the reader for an illustration of surrounding structures.

Figure 1:
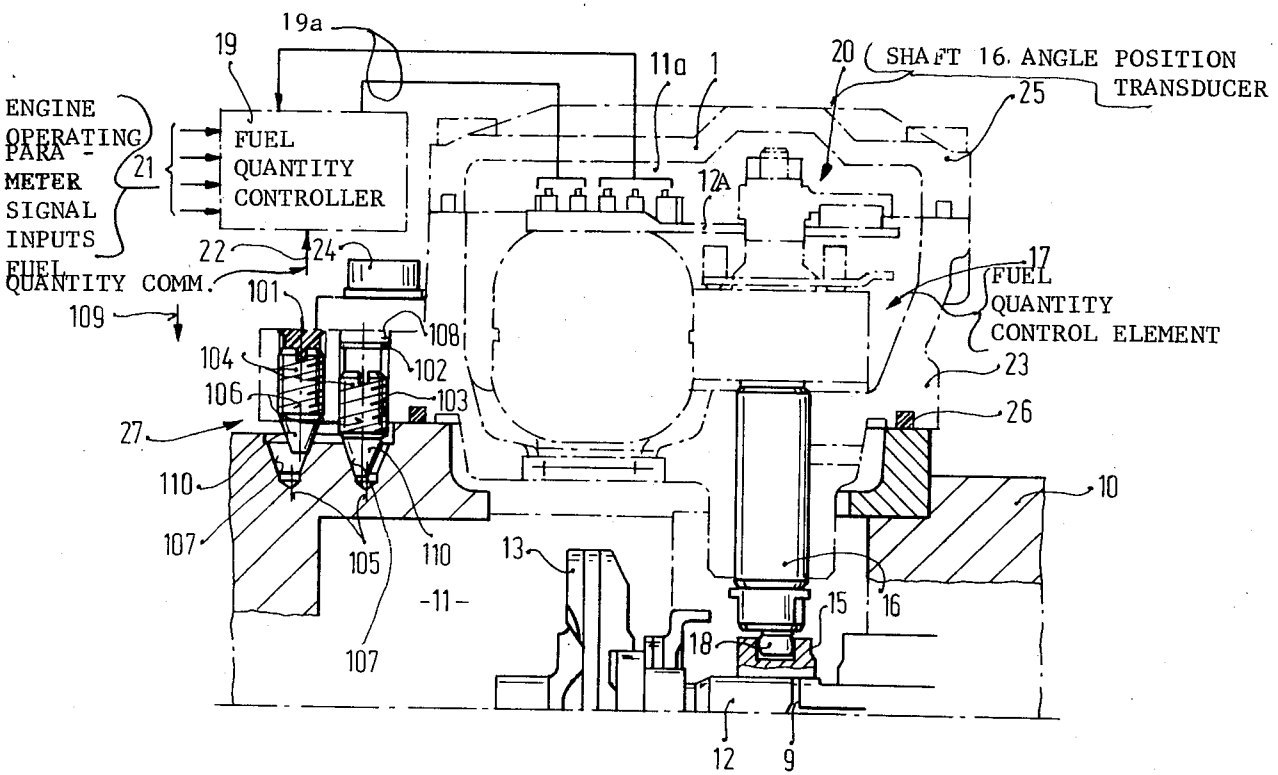
FIG. 1 is a schematic cross-sectional view through a distributor-type fuel injection pump, for example of the type suitable for a Diesel engine, in which only those parts material for an understanding of the present invention are shown in detail; the original drawing is to approximately natural scale.

The distributor-type fuel injection pump of FIG. 1 has a suction chamber 11 which is defined by a pump housing 10. A cam disk 13, for example driven by the internal combustion engine (ICE) with which the pump is to be used, engages an injection piston 12 to move the injection piston to-and-fro while, simultaneously, causing rotation of the injection piston to distribute fuel to various ducts within the pump housing for injection to respectively different cylinders of the ICE. The pump piston 12 is formed with a control bore 9, shown only in part. Fluid to be pumped is introduced to the pump piston to be injected thereby. The pumping pressure is effective upon reciprocating movement of the piston 12. The pumping pressure can be relieved by suitable placement of a control slider 15, surrounding the piston 12 in form of a collar, and, selectively, in accordance with its axial position, closing off or permitting escape of pressurized fluid into the suction chamber 11 upon exposure of the duct 9. Relative movement of the collar or slider 15 with respect to the piston 12 thus controls the quantity of fuel which will be injected by, for example, permitting drainage of pressurized fluid from the pressure side of the piston in advance of termination of the pressure stroke of the piston 12.

The position of the slider or collar 15 is determined by rotation of a shaft 16 which, at its end, is formed with an eccenter pin or eccenter roller 18, secured to shaft 16 and engaging in a groove of the collar or slider 15. The rotary position of the shaft 16 is determined and controlled by a rotary magnet fuel quantity control element 17, for example in form of a horseshoe-type electromagnet, energized and controlled by a fuel quantity controller 19. The connection between the fuel quantity controller and the fuel control element 17 has been omitted from the drawing for clarity. The fuel quantity controller 19 receives engine operation parameter input signals over lines 21 and, for example, a fuel quantity command signal over line 22, derived, for example, from a fuel control pedal controlled by the operator of the ICE, installed, for example, in an automotive vehicle. The engine operating parameter signals may include signals relating to the ambient temperature, engine temperature, whether the engine is operating under starting conditions, and the like. Output signals are conducted from the controller 19 to the fuel quantity control element 17 to control the position of the slider or collar 15 by rotation of shaft 16 and hence rotation of the eccenter 18. The angular position of the eccenter pin 18 is sensed by a shaft angle position transducer 20 which provides feedback control signals to the controller 19 so that the controller 19 can operate in a closed control loop. Additional feedback signals, to insure appropriate control operation of controller 19, are applied from sensors 11*a* located on a support 12*a* through control lines 19*a*, as is well known in this technology.

The electrical control system including the fuel quantity control element 17 is located in a control element housing 23. Control element housing 23 is secured to the housing 10 by a plurality of head screws 24, of which only one is visible in FIG. 1. The head screws 24 are located at suitable distances around the housing 10 to insure tight engagement of the housing 23 against the housing 10. To provide for tight seal with respect to high pressure which may exist in the pump housing 10, a sealing ring or gasket 26 is provided. The control element housing 23, itself, is closed off by a cover 25, in turn suitably closed by screws and a sealing ring. The relative position of the cover 25 on the housing 23 is not critical; the position of the housing 23, however, with respect to the housing 10 is extremely critical since the shaft 16, via the eccenter 18, engages the collar or slider 15 which, in turn, controls the quantity of fuel being injected. Thus, if after removal of the housing 23, for example, to replace the seal or gasket 26, misalignment of housing 23 with respect to housing 10 might result, the previously adjusted relationship of angular position of the shaft 16 with respect to the collar 15 will no longer prevail and, hence, an unintended change in the relationship of angular deflection of the shaft 16 with respect to quantity of injected fuel will be made.

In accordance with a feature of the present invention, the two housings 10 and 23 are formed with cooperative elements which insure that, after separation of the housings, a predetermined accurately defined relative position will always be reestablished.

FIG. 1 illustrates an interengaging positioning or locating system 27 in which the housing 23 is formed with two tapped bores 103, each including a threaded pin 104 having cone tips 110. The pump housing 10 has two conical bores 107 having axes 105 which are parallel with respect to each other and additionally parallel to the axes 106 of the tapped bores 103 in the control element housing 23. All axes, additionally, are parallel to a plane 109 which is the seating direction of the housing 23 with respect to housing 10. The relative spacing of the axes 106 of the cones 110 is less than the spacing of the axes 105 of the conical bores 107 in the housing 10. The cone angles of the cones 110 and of the cone bores or depressions 107 are identical, although this is not strictly necessary.

ASSEMBLY

The housing 10 and the housing 23 are fitted against each other and preliminarily secured by screws 24. Screws 24 are then tightened, cover 25 removed, and the angular position of the shaft 16 with respect to a datum or reference, and controlling the position of the slider or collar 15, is determined, adjusted, and then fixed and calibrated. If necessary, the housing 23 can be shifted slightly with respect to the housing 10 within slightly oversized holes through which the screws 24 pass. After thus positioning the housing 23 and the housing 10, and calibrating the relative position of the shaft 16 and of the collar 15, a screwdriver is used to screw the respective cone pins 104 in the associated cone opening 103 until the cone 110 engages the corresponding conical bore 107, as illustrated in FIG. 1. This, then, positively positions the housing. It is understood that more than one such positioning arrangement 27 may be provided, for example three such adjustments, positioned, preferably, approximately uniformly circumferentially around the housing 10; more such positioning units 27 may be provided. After positioning of the cones, tampering or unintended change, or any change of the positioning due to vibration, is prevented by, for example, filling a casting compound or sealing mass 101 in the remaining portion of the opening of the tapped bore 103; alternatively, a C-disk or similar expansion disk can be snapped into a groove or recess 108 within the tapped bore 103.

The arrangement permits ready recalibration, for example in a shop, or upon wear of the cam or of the piston, or replacement of the piston and/or the slider 15, or, for example, to associate a fuel quantity control element 17 within a housing with a replacement distributor pump 10. For readjustment, the housings are separated, and the cone screws 106 screwed out from the housings, and, for example, mass 101 or the snap ring 102 then removed. Upon recalibration of the fuel quantity control element with respect to the piston 12, with the housings re-seated and re-tightened, for example with new seals 26, the cone screws 106 are again engaged with the respective cone openings 107, and the cones positoned, as previously described. Thereafter, it is an easy matter to remove the housing 23, for example by loosening the screws 24, replace the gasket 26 and reestablish the previously established relationship of the housing 23 with the housing 10 since the cones 106 will have remained in position for engagement with the cone openings 107, as previously established.

Various other ways of interengaging projection-and-recess arrangements to locate housing 10 with respect to housing 23 in clearly defined relationship are possible. The arrangement 27 described in connection with FIG. 1 has the advantage of re-adjustability to permit, for example, selective replacement of the pump 10, and/or the control element 17, each within the respective housing, as a unit, and recalibration. The conical surfaces, however, require special machining and, hence, more than the most rudimentary production steps. Different and simpler arrangements for positively associating the housing parts 10 and 23 will be described with reference to FIGS. 2–8, and 9*a*, 9*b*, in which only those portions of the housings 10 and 23 immediately associated with the locating arrangement are shown.

EMBODIMENT OF FIG. 2

Figure 2:
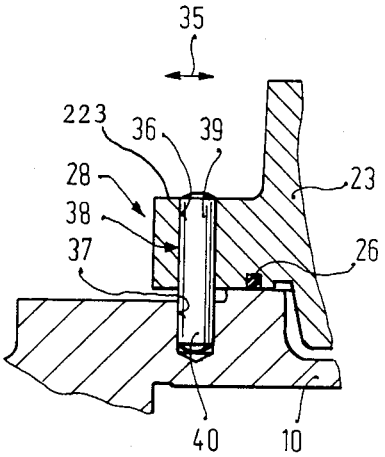
FIGS. 2–8 are fragmentary axial views illustrating different adjustment arrangements of the pump housing and the fuel quantity control housing, respectively.

The locating arrangement 28 is positioned with respect to the housing 10 after adjustment in position in accordance with a double arrow 35. First, housings 10 and 23 are relatively placed in a fixed predetermined location, in which the calibration of the quantity control element 17 and the piston 12 has been determined. Screws 24 are tightened. The housing 23 is formed with a projecting flange 223 which, initially, is solid. By a single drilling operation, a through-bore will be formed in the flange 223 and, simultaneously, a blind bore will be formed in the pump housing 10. Since a single drilling operation is used, the through-bore 36 and the blind bore 37 will be in precise alignment. A pin 38 is then press-fitted into the bore 36. The pin 38 has a lower portion 40 which is just slightly smaller in diameter to form a snug, but removable sliding fit with the bore 37. FIG. 2 shows the assembled connection, in which the pin 38 has already been press-fitted in the opening 36 and is positoned, in accurate sliding fit relation to the blind bore 40.

After loosening of the screws 24 (FIG. 1) and, for example, removal of the housing 23 from housing 10 by sliding out the portions 40 of the pins 36 from the blind bore 37, it is always readily possible to reestablish the previous accurately aligned position by reinserting the sliding fit portions 40 of the pins 38 into the respective openings 37. Preferably, the ends 40 of the pins 38 are chamfered at their free end. Screws 24 then can be tightened, thereby insuring a tight connection of the housing 23 with housing 10 in accurately aligned position.

EMBODIMENT OF FIG. 3

In the embodiments to follow, the housings 10, 23 have already been positioned in accurately predetermined relative location, and have been connected together by screws 24 which are tightened.

Figure 3:
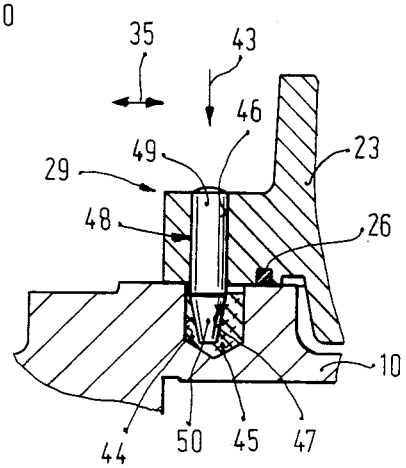
Figure 4:
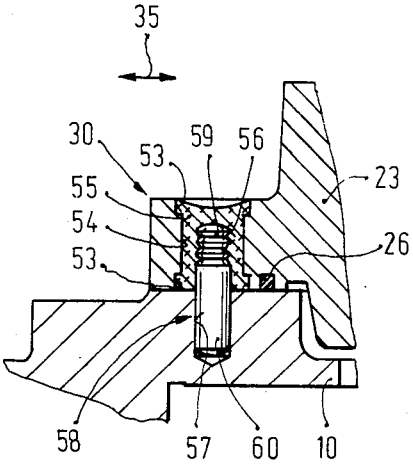
Figure 5:
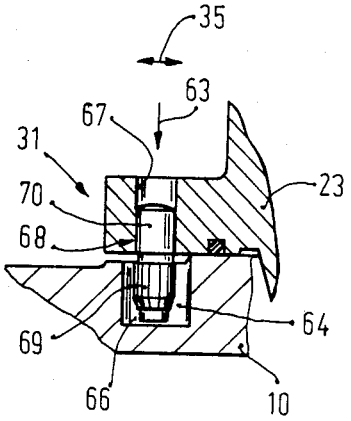

Embodiment of FIG. 3: Housing 10 is formed with a hole 44, which is larger than the cross-sectional area of a bolt 48. Bolt 48, which forms the projection means of the projection-and-recess interengaging connection, tapers, to have frusto-conical form, in the direction of the insertion movement, as illustrated schematically by arrow 43. The control element housing 23 is formed with a through-bore 46 in which the bolt 48 is press-fitted. Based on the assumption that the housings 10, 23 are connected together in precisely adjusted position, bolt 48 is press-fitted into the housing 23, thereby compressing the curable or hardenable mass 45, and forming its own fitting or interengaging hole. At first, the mass 45 is merely filled into the opening 44, in sufficient quantity to leave room for the portion of the pin 48 to engage into the mass 45, the mass 45 then curing or hardening. Upon removal of the housings 10 and 23 from each other, reinsertion is readily possible by fitting the ends 50 of the bolts into the thus-established adjustment openings 47. Prior to first inserting the end portion 50 into the mass 45, it may be coated with a release agent to prevent adhesion of the mass 45 to the bolt portion 50.

EMBODIMENT OF FIG. 4

The attachment arrangement 30 is, essentially, the reverse of the arrangement 29 of FIG. 3. In accordance with FIG. 4, the controller housing 23 is formed with an opening 54, which has two circumferential grooves 53. A bolt 58 has a portion 60 which will form the projecting portion of the projection-and-recess interengaging arrangement. The housing 10 is formed with a blind bore 57, into which the projecting portion 60 of the bolt 58 fits with a snug sliding fit. The bolt 60 is formed with a plurality of circumferential or spiral ring depressions 56 in the region in which it extends within the opening 54. After adjustment of the housing portions 10, 23 relative to each other, a hardening or curable compound 55 is poured into the opening 54 to cement and seat and securely anchor the bolt 58 in the opening 54 by engagement of the sealing mass with the respective grooves or spirals 53, 56. A heat-resistant epoxy compound is suitable.

FIG. 5

The arrangement 31 includes a through-bore 67 formed in the housing 23. This is the calibration or adjustment opening. The pump housing 10 is formed with an elongated or oval hole 66 which has its longitudinal sides parallel to the adjustment direction as indicated by the double arrow 35. The bolt portion 70 is located within the opening 67 in sliding position; the jacket portion of the bolt 68 which is to seat in the elongated hole 66, is formed with a knurled or ribbed surface 64 parallel to the insertion direction 63, and slightly smaller than the diameter of the portion to fit within the hole 67.

After positioning of the housings 10 and 23, the bolt portion 69 is pushed through the opening 67 and then press-fitted in the housing portion 10 such that the knurls or ribs 64 will press-fit themselves in the elongated hole 66 and form a fixed irremovable connection with the housing 10, and hence positioning the housing 23. For removal, the housing 23 is lifted off the now securely seated and positioned pins by sliding movement with respect to the portion 70 of the bolt or pin.

EMBODIMENT OF FIG. 6, ARRANGEMENT 32

The pump housing 10 is formed with a blind bore 77 in which the bolt section 80 can be fitted in a sliding snug fit. The controller housing 23 is fitted with a longitudinal or elongated or oval hole 73, and a groove 72 with two groove flanks or sides 76, of which only one is seen in the drawing. Both longitudinal edges of the hole 73 and the flanks 76 are parallel to the adjustment direction schematically shown by the double arrow 35.

After fitting the housings 10, 23, the bolt 80 is inserted into the opening 77. A washer 75, which has edges parallel to the flanks 76 of the groove, is then pressed on the bolt, the edges having ribs or ridges formed thereon, so that the toothed or ribbed edges of the washer will engage in the flanks 76 of the housing 23, insuring a fixed connection of the bolt 78 with the housing 23.

As an alternative to toothed or ribbed edges of a washer 75, it is possible to use a washer 75 which is slightly oversized with respect to the spacing between the sides or flanks 76 of the groove 72, and to press-fit the oversized washer into the groove; it is also possible, of course, to utilize a washer which fits snugly into the groove, and deform the fitted washer when properly seated.

EMBODIMENT OF FIG. 7, ARRANGEMENT 33

Figure 6:
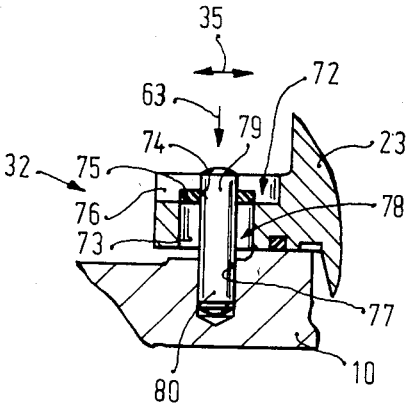
Figure 7:
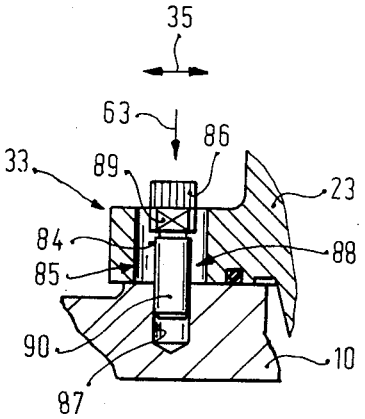

The arrangement is quite similar to that of FIG. 6, except that the portion 89 of the bolt 88 is formed with a ribbed or knurled end 86 and the two longitudinal sides 84 of the elongated hole 85 are slightly undersized with respect to the ribbed head of the bolt. The insertion direction is again shown by arrow 63.

After locating the housing 23 with respect to the housing 10, the bolt portion 90 is inserted in the insertion direction 63 in the opening 87, the toothed or ribbed circumference 86 being press-fitted in the elongated or oval hole 85, the toothed or ribbed circumference insuring a tight connection of the bolt 88 with the housing 23, without danger of looseness or shifting.

EMBODIMENT OF FIG. 8, ARRANGEMENT 34

The housing 23 is formed with a blind bore 96, and has a bottom 95. A steel bushing 94 is press-fitted in a recess 93 of the pump housing 10. After alignment of the housings 10, 23 with respect to each other, a punch tool 92 is inserted in the direction of the arrow 63, to punch out a projection from the housing 23 to fit within the steel bushing 94 of the housing 10, to thereby form a protecting portion 100 extending from the housing 23. The punch 92 is moved in the direction of the bottom 95 of the housing 23.

EMBODIMENT OF FIG. 9 (COLLECTIVELY), ARRANGEMENT 35'

Figure 8:
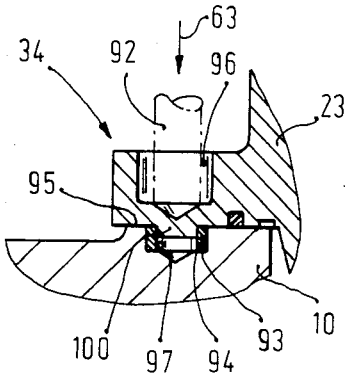
Figure 9A:
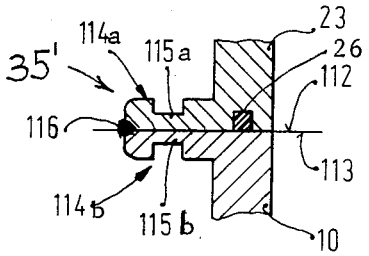
Figure 9B:
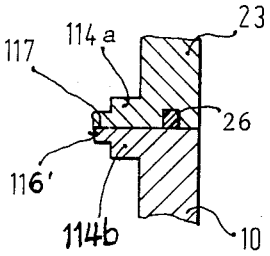

In all the prior embodiments, the positioning of the respective housings 10, 23 was determined by interengaging projection-and-recess elements, such as bolts, pins, cones, or a projection (FIG. 8). In the embodiments of FIGS. 9*a*, 9*b*, the housings are formed with an extending flange 114*a*, 114*b*, respectively, having, each, a predetermined break-away or break-off position 15, for example defined by a V-notch within a recessed portion 115*a*, 115*b*, of the flanges 114*a*, 114*b*. The ribs 114*a*, 114*b* engage within the region of the end surfaces 112, 113 of the respective housings 10, 23. After fitting the housings 10, 23 with respect to each other, which is carried out in any direction in a plane perpendicular to the plane of the drawing, and attaching the housings by the screws 24, the housings are then secured together by spot welds or welding tips 116.

To separate the housings, the spot weld 116 with the immediately adjacent region of the ribs 114*a*, 114*b* is broken off at the break-away region 115*a*, 115*b*. The housings 10, 23, upon re-assembly, can easily be aligned by accurately aligning the surfaces of the break-away zones 115*a*, 115*b* with respect to each other, if necessary, by fitting the previously broken-away and welded-together elements 114*a*, 114*b* against the remaining portions of the break-away zones 115*a*, 115*b*. For subsequent re-attachment, a new spot weld or welding point 116' can be placed, as seen in FIG. 9*b*.

Any one of the various attachment arrangements is preferably located at various points of the housings 10, 23, for example essentially uniformly distributed thereabout, and not less than at two, and preferably at three or more points.

Various changes and modifications may be made, and any features described herein, for example in connection with any one of the embodiments, may be used with any of the others, within the scope of the inventive concept.

The invention has been described with reference to a fuel injection pump for Diesel engines, but, of course, can be used also with fuel injection pumps for other types of internal combustion engines.

We claim:

1. Fuel injection pump—injection quantity control element combination having a pump housing (10) retaining an injection element (12,15), and a control element housing (23) removably secured to the pump housing (10) and retaining a control element (16, 17, 18) interengageable with the injection element and controlling the quantity of fuel being injected, wherein the relative positions of the pump housing (10) and of the control element housing (23) are determinative of the adjustment of the interengagement between the injection element (12, 15) and the control element (16–18), comprising, in accordance with the invention, separable position locating means (27–34, 35') determining the relative position of the pump housing (10) and the control element housing (23) upon first assembling the housings with each other, and constraining reestablishment of said relative position after separation and re-assembly of said housings, said position locating means comprising a bolt (38, 48, 58, 68, 78, 88) having a projecting portion (40, 50, 60, 70, 80, 90, 100, 110) extending from one of the housings (10, 23) toward the other, and a fitting recess (37, 47, 57, 67, 77, 87, 97, 107), in the other one of the housings, and wherein the projection is fitted into the recess upon assembly of said housings and determination of the relative position of said housings; and wherein (FIG. 3) one (23) of the housings is formed with a through-bore (46);

said bolt (48) is fitted in said through-bore with an interference fit and has a projecting portion (50);

the other one (10) of the housings being formed with an opening (44) larger than the diameter of the bolt;

and a hardening mass is provided within said opening (44) surrounding the bolt and forming with the bolt, upon hardening, an adjustment opening for the bolt.

2. Fuel injection pump—injection quantity control element combination having a pump housing (10) retaining an injection element (12,15), and a control element housing (23) removably secured to the pump housing (10) and retaining a control element (16, 17, 18) interengageable with the injection element and controlling the quantity of fuel being injected, wherein the relative positions of the pump housing (10) and of the control element housing (23) are determinative of the adjustment of the interengagement between the injection element (12, 15) and the control element (16–18), comprising, in accordance with the invention, separable position locating means (27–34, 35') determining the relative position of the pump housing (10) and the control element housing (23) upon first assembling the housings with each other, and constraining reestablishment of said relative position after separation and re-assembly of said housings, said position locating means comprising a bolt (38, 48, 58, 68, 78, 88) having a projecting portion (40, 50, 60, 70, 80, 90, 100, 110) extending from one of the housings (10, 23) toward the other, and a fitting recess (37, 47, 57, 67, 77, 87, 97, 107), in the other one of the housings, and wherein the projection is fitted into the recess upon assembly of said housings and determination of the relative position of said housings; and wherein (FIG. 4) one (10) of the housings is formed with a recess (57) snugly and slidably receiving a portion (60) of the bolt (68);

and the other one (23) of the housings is formed with an opening (54) larger than the diameter of the bolt, the surface of the bolt being formed with at least one depression (56);

and a hardenable compound (55) fitted in the opening of the other one (23) of the housings, penetrating into the depression (56) on the surface of the bolt, and securely retaining the bolt within the housing in aligned, adjusted and oriented position within said opening.

3. Combination according to claim 2, further including an undercut or groove (53) formed within the opening (54) in the other one (23) of the housings to securely retain the curable or hardenable compound therein.

4. Fuel injection pump—injection quantity control element combination having a pump housing (10) retaining an injection element (12, 15), and a control element housing (23) removably secured to the pump housing (10) and retaining a control element (16, 17, 18) interengageable with the injection element and controlling the quantity of fuel being injected, wherein the relative positions of the pump housing (10) and of the control element housing (23) are determinative of the adjustment of the interengagement between the injection element (12, 15) and the control element (16–18), comprising, in accordance with the invention, separable position locating means (27–34, 35') determining the relative position of the pump housing (10) and the control element housing (23) upon first assembling the housings with each other, and constraining reestablishment of said relative position after separation and re-assembly of said housings, said position locating means comprising a bolt (38, 48, 58, 68, 78, 88) having a projecting portion (40, 50, 60, 70, 80, 90, 100, 110) extending from one of the housings (10, 23) toward the other, and a fitting recess (37, 47, 57, 67, 77, 87, 97, 107), in the other one of the housings, and wherein the projection is fitted into the recess upon assembly of said housings and determination of the relative position of said housings;

wherein (FIGS. 6, 7) one (10) of the housings is formed with a bore (77) snugly and slidably receiving a portion (80) of the bolt, the other one (23) of the housings being formed with an elongated opening (73);

the bolt having a portion (79) being formed with longitudinal ribs, the diameter of the ribbed bolt portion being larger than the diameter of the portion of the bolt fitting into the bore (77) in said one housing (10);

and wherein the bolt is press-fitted into the elongated opening (73), with the ribs biting into the surfaces defining the elongated opening for securely and irremovably seating the bolt in predetermined position within said opening and thus providing for maintenance of alignment and relative adjustment of the housings (10, 23) with respect to each other.

5. Combination according to claim 4, wherein the circumferential ribs or teeth form sharply pointed radially projecting teeth.

6. Fuel injection pump—injection quantity control element combination having a pump housing (10) retaining an injection element (12, 15), and a control element housing (23) removably secured to the pump housing (10) and retaining a control element (16, 17, 18) interengageable with the injection element and controlling the quantity of fuel being injected, wherein the relative positions of the pump housing (10) and of the control element housing (23) are determinative of the adjustment of the interengagement between the injection element (12, 15) and the control element (16–18), comprising, in accordance with the invention, separable position locating means (27–34, 35') determining the relative position of the pump housing (10) and the control element housing (23) upon first assembling the housings with each other, and constraining reestablishment of said relative position after separation and re-assembly of said housings, said position locating means comprising a bolt (38, 48, 58, 68, 78, 88) having a projecting portion (40, 50, 60, 70, 80, 90, 100, 110) extending from one of the housings (10, 23) toward the other, and a fitting recess (37, 47, 57, 67, 77, 87, 97, 107), in the other one of the housings, and wherein the projection is fitted into the recess upon assembly of said housings and determination of the relative position of said housings; and wherein (FIG. 6) one (10) of the housings is formed with an opening snugly and slidably receiving a portion (80) of the bolt, and the other one (23) of the housings is formed with an elongated opening (73) receiving another portion (79) of the bolt;

the opening in the other one (23) of the housings defining opening sides (76) and a tightly fitting retaining washer (75) fitted on the portion (79) of the bolt extending into the opening in the other one (23) of the housings and engaging the sides (76) of the opening (73) therein.

7. Combination according to claim 6, wherein said washer (75) includes ribs or teeth which, upon press-fitting into the opening (73) engage the flanks or sides (73) of the opening to securely and immovably retaining the bolt in said opening.

8. Combination according to claim 6, wherein said opening (73) is formed with a groove;

and said washer comprises a snap or spring washer snapped and fitted into said groove.

9. Combination according to claim 6, wherein said opening (73) is formed with a groove;

and said washer (75) is deformed in the region of engagement with the groove to immovably retain the bolt within the opening.

10. Fuel injection pump—injection quantity control element combination having a pump housing (10) retaining an injection element (12, 15), and a control element housing (23) removably secured to the pump housing (10) and retaining a control element (16, 17, 18) interengageable with the injection element and controlling the quantity of fuel being injected, wherein the relative positions of the pump housing (10) and of the control element housing (23) are determinative of the adjustment of the interengagement between the injection element (12, 15) and the control element (16–18), comprising, in accordance with the invention, separable position locating means (27–34, 35′) determining the relative position of the pump housing (10) and the control element housing (23) upon first assembling the housings with each other, and constraining reestablishment of said relative position after separation and re-assembly of said housings, said position locating means comprising a bolt (38, 48, 58, 68, 78, 88) having a projecting portion (40, 50, 60, 70, 80, 90, 100, 110) extending from one of the housings (10, 23) toward the other, and a fitting recess (37, 47, 57, 67, 77, 87, 97, 107), in the other one of the housings, and wherein the projection is fitted into the recess upon assembly of said housings and determination of the relative position of said housings; and wherein (FIG. 8) one (10) of the housings is formed with an opening (96);

a reinforcing steel bushing (94) is secured within the opening;

and wherein the other one (23) of the housings, after alignment and positioning of said housings with respect to each other, is formed with a punch-out projection (100) extending into and snugly received within the steel bushing.

11. Fuel injection pump—injection quantity control element combination having a pump housing (10) retaining an injection element (12, 15), and a control element housing (23) removably secured to the pump housing (10) and retaining a control element (16, 17, 18) interengageable with the injection element and controlling the quantity of fuel being injected, wherein the relative positions of the pump housing (10) and of the control element housing (23) are determinative of the adjustment of the interengagement between the injection element (12, 15) and the control element (16–18), comprising, in accordance with the invention, separable position locating means (27–34, 35′) determining the relative position of the pump housing (10) and the control element housing (23) upon first assembling the housings with each other, and constraining reestablishment of said relative position after separation and re-assembly of said housings, said position locating means comprising a bolt (38, 48, 58, 68, 78, 88) having a projecting portion (40, 50, 60, 70, 80, 90, 100, 110) extending from one of the housings (10, 23) toward the other, and a fitting recess (37, 47, 57, 67, 77, 87, 97, 107), in the other one of the housings, and wherein the projection is fitted into the recess upon assembly of said housings and determination of the relative position of said housings; and wherein (FIG. 1) one (10) of the housings is formed with two conical bores (107) and the other one (23) of the housings is formed with tapped openings (103) spaced differently from the spacing of the two conical bores (107);

and wherein two threaded adjustment bolts (104) are provided, one each threaded into one of the tapped openings, each one of the adjustment bolts having cone tips (110) matching, at least approximately, the conical bores (107) within said one housing (10);

and wherein the relative position, in adjustment and alignment, of said two housings (10, 23) is determined by the relative depth of engagement of the cones (110) on the threaded bolts (104) with the conical bores in said one housing.

12. Combination according to claim 11, wherein the cone openings and the cones of the threaded bolts all have axes which extend parallel to the direction of assembly (109) with each other.

13. Combination according to claim 11, wherein the threaded bolts are shorter than the thickness of the other one (23) of said housings;

and a closing element (102, 104) is provided, closing off the threaded openings after insertion of said threaded bolts, and adjustment of the cones thereon with respect to the conical openings in said one (10) housing.

14. Fuel injection pump—injection quantity control element combination having a pump housing (10) retaining an injection element (12, 15), and a control element housing (23) removably secured to the pump housing (10) and retaining a control element (16, 17, 18) interengageable with the injection element and controlling the quantity of fuel being injected, wherein the relative positions of the pump housing (10) and of the control element housing (23) are determinative of the adjustment of the interengagement between the injection element (12, 15) and the control element (16–18), comprising, in accordance with the invention, separable position locating means (27–34, 35′) determining the relative position of the pump housing (10) and the control element housing (23) upon first assembling the housings with each other, and constraining reestablishment of said relative position after separation and re-assembly of said housings, said position locating means comprising a bolt (38, 48, 58, 68, 78, 88) having a projecting portion (40, 50, 60, 70, 80, 90, 100, 110) extending from one of the housings (10, 23) toward the other, and a fitting recess (37, 47, 57, 67, 77, 87, 97, 107), in the other one of the housings, and wherein the projection is fitted into the recess upon assembly of said housings and determination of the relative position of said housings; and wherein (FIG. 1) one (10) of said housings is formed with at least one conical opening (107);

and the other one (23) of said housing is formed with a conical projection (104, 110) fitting, at least in part, within said conical opening, the cone angles of said projection and said conical opening being at least approximately the same.

15. Fuel injection pump—injection quantity control element combination having a pump housing (10) retaining an injection element (12, 15), and a control element housing (23) removably secured to the pump housing (10) and retaining a control element (16, 17, 18) interengageable with the injection element and controlling the quantity of fuel being injected, wherein the relative positions of the pump housing (10) and of the control element housing (23) are determinative of the adjustment of the interengagement between the injection element (12, 15) and the control element (16–18), comprising, in accordance with the invention, separable position locating means (27–34, 35') determining the relative position of the pump housing (10) and the control element housing (23) upon first assembling the housings with each other, and constraining reestablishment of said relative position after separation and re-assembly of said housings, and wherein the position locating means comprises an extending flange (**114*a*, 114*b***) extending from each one of the housings, the flanges being adjacent and in surface engagement with each other;

each one of the flanges being formed with a break-away zone (**115*a*, 115*b***);

and a spot-weld connection (116) connecting the ribs (**114*a*, 114*b*) of the housing together at a position beyond the break-away zone to accurately align and position the housings with respect to each other, but permit breaking away of the flange portions (114*a*, 114*b*) beyond the breakaway zone upon separation of the housings (10, 23**) from each other, and re-assembly by alignment of the break-away portions.

* * * * *